US008555982B2

(12) United States Patent
Luppi

(10) Patent No.: US 8,555,982 B2
(45) Date of Patent: Oct. 15, 2013

(54) METHOD FOR SETTING UP A HYBRID TOWER IN AN EXPANSE OF WATER, HYBRID TOWER ASSOCIATED INSTALLATION FOR EXPLOITING FLUIDS

(75) Inventor: Ange Luppi, Nimes (FR)

(73) Assignee: Technip France (FR)

( * ) Notice: Subject to any disclaimer, the term of this patent is extended or adjusted under 35 U.S.C. 154(b) by 279 days.

(21) Appl. No.: 13/000,675

(22) PCT Filed: Jun. 25, 2009

(86) PCT No.: PCT/FR2009/051214

§ 371 (c)(1),
(2), (4) Date: Mar. 9, 2011

(87) PCT Pub. No.: WO2009/156695

PCT Pub. Date: Dec. 30, 2009

(65) Prior Publication Data

US 2011/0147003 A1 Jun. 23, 2011

(30) Foreign Application Priority Data

Jun. 27, 2008 (FR) ..... 08 54337

(51) Int. Cl.
*E21B 17/01* (2006.01)

(52) U.S. Cl.
USPC ..... 166/367; 166/341; 166/350; 166/85.1; 405/184.4

(58) Field of Classification Search
USPC ..... 166/367, 338, 341, 344–347, 350–352, 166/360, 378–380, 85.1, 241.1; 285/24, 27, 285/334.5; 405/169–172, 184.4, 405/224.2–224.4; 441/1, 133
See application file for complete search history.

(56) References Cited

U.S. PATENT DOCUMENTS

| | | | | |
|---|---|---|---|---|
| 3,788,396 | A * | 1/1974 | Shatto et al. | 166/341 |
| 4,102,146 | A * | 7/1978 | Dietrich | 405/169 |
| 4,182,584 | A * | 1/1980 | Panicker et al. | 405/224.3 |
| 4,367,055 | A * | 1/1983 | Gentry et al. | 405/169 |

(Continued)

FOREIGN PATENT DOCUMENTS

| | | | |
|---|---|---|---|
| FR | 2821143 | A | 8/2002 |
| GB | 1343897 | A | 1/1974 |
| WO | WO 97/22780 | A | 6/1997 |
| WO | WO 2007/023233 | A | 3/2007 |

OTHER PUBLICATIONS

International Search Report dated Nov. 6, 2009, issued in corresponding international application No. PCT/FR2009/051214.

*Primary Examiner* — Matthew Buck
(74) *Attorney, Agent, or Firm* — Ostrolenk Faber LLP

(57) ABSTRACT

A method includes the positioning of a rising column (22) in a vertical configuration and the total immersion of a buoy for retaining the rising column (22).
The method includes the insertion of a male connecting member (62) borne by the buoy in a female connecting member (64) borne by the rising column (22) and the immobilization of the male connecting member (62) in a receiving passage (92) defined by the female connecting member (64).
The female connecting member (64) includes at least one surface (98) for guiding the male connecting member (62) towards the receiving passage (92). The insertion step including the guiding of the male connecting member (62) towards the receiving passage (92) by contact with a guiding surface (98) of the female connecting member (64) which has a vertical section diverging away from the receiving passage (92) towards the male connecting member (62).

9 Claims, 7 Drawing Sheets

(56) References Cited

U.S. PATENT DOCUMENTS

| | | | | | |
|---|---|---|---|---|---|
| 4,423,984 | A * | 1/1984 | Panicker et al. | 405/224.3 |
| 4,490,073 | A * | 12/1984 | Lawson | 405/169 |
| 4,547,163 | A * | 10/1985 | Langpaap et al. | 441/2 |
| 4,585,369 | A * | 4/1986 | Manesse et al. | 403/322.3 |
| 4,643,614 | A * | 2/1987 | Laursen | 405/169 |
| 4,762,180 | A * | 8/1988 | Wybro et al. | 166/350 |
| 4,848,949 | A * | 7/1989 | Castel | 403/12 |
| 4,878,694 | A * | 11/1989 | Castel | 285/24 |
| 5,046,896 | A | 9/1991 | Cole | |
| 6,042,303 | A * | 3/2000 | Head | 405/195.1 |
| 6,082,391 | A * | 7/2000 | Thiebaud et al. | 137/236.1 |
| 6,321,844 | B1 * | 11/2001 | Thiebaud et al. | 166/345 |
| 6,367,846 | B1 * | 4/2002 | Aaron, III | 285/123.15 |
| 6,461,083 | B1 * | 10/2002 | Pionetti et al. | 405/224.2 |
| 6,568,712 | B1 * | 5/2003 | Aaron, III | 285/24 |
| 6,854,930 | B2 * | 2/2005 | Pionetti | 405/172 |
| 7,025,535 | B2 * | 4/2006 | Chiesa et al. | 405/169 |
| 7,059,416 | B2 * | 6/2006 | Dailey et al. | 166/359 |
| 7,073,593 | B2 * | 7/2006 | Hatton et al. | 166/367 |
| 7,197,999 | B2 * | 4/2007 | Murray | 114/264 |
| 7,404,695 | B2 * | 7/2008 | Chenin | 405/224.3 |
| 7,434,624 | B2 * | 10/2008 | Wilson | 166/368 |
| 7,572,085 | B2 * | 8/2009 | Luppi | 405/158 |
| 7,591,316 | B2 * | 9/2009 | Hatton | 166/355 |
| 7,934,560 | B2 * | 5/2011 | Roveri et al. | 166/345 |
| 7,946,790 | B2 * | 5/2011 | Casola et al. | 405/169 |
| 8,123,437 | B2 * | 2/2012 | Wolbers et al. | 405/172 |
| 8,136,599 | B2 * | 3/2012 | Alliot | 166/350 |
| 2007/0044972 | A1 * | 3/2007 | Roveri et al. | 166/367 |

* cited by examiner

METHOD FOR SETTING UP A HYBRID TOWER IN AN EXPANSE OF WATER, HYBRID TOWER ASSOCIATED INSTALLATION FOR EXPLOITING FLUIDS

CROSS REFERENCE TO RELATED APPLICATIONS

The present application is a 35 U.S.C. §371 National Phase conversion of PCT/FR2009/051214, filed Jun. 25, 2009, which claims benefit of French Application No. 08 54337, filed Jun. 27, 2008, the disclosure of which is incorporated herein by reference. The PCT International Application was published in the French language.

BACKGROUND OF THE INVENTION

The present invention relates to a method for setting up a hybrid tower in an expanse of water, of the type comprising the following steps:

- positioning and temporarily retaining a rigid rising column in a substantially vertical configuration in the expanse of water,
- totally immersing a buoy for retaining the rising column and displacing the retaining buoy facing the rising column;
- inserting a male connecting member borne by a first of the rising column and of the retaining buoy, into a female connecting member borne by a second of the rising column and of the retaining buoy;
- immobilizing the male connecting member in a receiving passage defined by the female connecting member Such a hybrid tower is for example mounted in an expanse of water such as a lake, a sea or an ocean in order to connect fluid exploitation wells opening out into the bottom of the expanse of water to an assembly for storing and/or discharging this fluid, located at the surface.

For this purpose, the hybrid tower generally comprises a substantially vertical rigid rising column anchored on the bottom of the expanse of water. The rising column is maintained in a vertical configuration by a buoy totally immersed under the expanse of water and attached to the upper end of the column.

A flexible member connects the upper end of the rising column to the surface assembly.

The fluid to be exploited is thereby conveyed between the bottom of the expanse of water and the surface, successively through the rising column and the flexible pipe.

Such a hybrid tower is generally set up in the expanse of water by first of all positioning on the bottom of the expanse of water, a lower connecting assembly comprising a foundation, such as a suction pile or a gravity baseplate and a bent connecting joint which is mounted at the end of an exploitation line stemming from the fluid wells.

And then the rising column, provided with an upper connecting joint is immersed in the expanse of water and is positioned in a vertical position. It is then maintained temporarily in a vertical position by mooring to the laying surface ship.

This column is for example lowered by a so-called J-laying method or by an S-laying method. Alternatively, this column may be made onshore and towed onto the installation site before being immersed.

Next, the retaining buoy is immersed and then tilted into the vertical position, before connecting it onto a connecting joint at the upper end of the rising column.

For this purpose, the connecting means between the buoy and the rising column for example comprise a rod borne by the buoy, and connected to the latter through a chain, and a mandrel for tightening the rod, borne by the rising column. During the connection of the buoy, the rod is introduced into the mandrel before being immobilized in position.

The floatability of the buoy generates a force pulling the rising column upwards, which retains the pipe in its vertical configuration. The temporary mooring means on the laying ship are then released.

Such a method does not give entire satisfaction. Indeed, the connection of the buoy on the rising column is carried out in an immersed medium at several tens of meters under the sea level. As the high portion of the rising column is subject to currents and to swell, it generally oscillates around a vertical central position.

Further, the buoy is often very bulky, since the hybrid towers are capable of having a height of more than 1,500 meters. Thus the buoy should have a diameter of more than several meters for a height of several tens of meters. It is therefore very difficult to maneuver it specifically under the expanse of water.

SUMMARY OF THE INVENTION

An object of the invention is therefore to provide a method for setting up a hybrid tower which is simpler to apply, notably when the current or/and the swell are strong.

For this purpose, the object of the invention is a method of the aforementioned type, characterized in that the female connecting member comprises at least one surface for guiding the male connecting member towards the receiving passage, the guiding surface opening out around the receiving passage and having a vertical section diverging away from the receiving passage towards the male connecting member upon introducing the male connecting member into the female connecting member, the insertion step comprising the guiding of the male connecting member towards the receiving passage by contact with the guiding surface.

The method according to the invention may comprise one or more of the following features, taken individually or according to all technically possible combinations:

- the one of the male connecting member and of the female connecting member borne by the retaining buoy is mounted so as to be transversally mobile relatively to the retaining buoy between an axial rest configuration substantially parallel to a vertical axis A-A' and a guiding configuration tilted by a non-zero angle relatively to the vertical axis A-A', the insertion step comprising the displacement of the one of the male connecting member and of the female connecting member borne by the retained buoy between its axial configuration and its tilted configuration during the contact of the male connecting member with the guiding surface,
- the retaining buoy is connected to the one of the male connecting member and of the female connecting member borne by the retaining buoy by a substantially vertical line, the one of the male connecting member and of the female connecting member borne by the retaining buoy being pivotally mounted around a transverse axis on the line,
- the immobilization step comprises the clamping of the male connection member by an immobilization clamp mounted on the female connecting member,
- the method comprises, after the immobilization step, a step for connecting on the rigid rising column a flexible pipe for connecting to a surface assembly, the flexible connecting pipe being connected in the vicinity of the male connecting member and of the female connecting member.

The object of the invention is also a hybrid tower intended to be positioned in an expanse of water, comprising:

an rising rigid column intended to be positioned according to a vertical configuration in the expanse of water;

a retaining buoy of the rising column, the retaining buoy being intended to be totally immersed in the expanse of water, means for connecting the retaining buoy to an upper end of the rising column, the connecting means comprising a male connecting member borne by a first of the retaining buoy and of the rising column, and a female connecting member borne by a second of the retaining buoy and of the rising column;

the male connecting member and the female connecting member being mobile relatively to each other between a disconnected position and a connected position in which the male connecting member is received in a receiving passage defined by the female connecting member;

characterized in that the female connecting member delimits a surface for guiding the male connecting member opening out into the receiving passage, the guiding surface diverging away from the receiving passage towards the male connecting member upon introducing the male connecting member into the female connecting member.

The hybrid tower according to the invention may comprise one or more of the following features, taken individually or according to all technically possible combinations:

the guiding surface is a solid surface.

the guiding surface is of a substantially frusto-conical shape.

the one of the male connecting member and of the female connecting member borne by the retaining buoy are mounted so as to be transversally mobile relatively to the retaining buoy between an axial rest configuration substantially parallel to a vertical axis A-A' and a guiding configuration tilted by a non zero angle relatively to the vertical axis A-A', the retaining buoy is connected to the one of the male connecting member and of the female connecting member borne by the retaining buoy by a substantially vertical line, the one of the male connecting member and of the female connecting member borne by the retaining buoy being pivotally mounted around a transverse axis on the line, the connecting means comprise a clamp for immobilizing the male connecting member in the receiving passage, the immobilization clamp being mounted on the female connecting member, the hybrid tower comprises a flexible pipe connecting with a surface assembly, the flexible connecting pipe being connected to the rigid rising column in the vicinity of the connecting means.

The object of the invention is also an installation for exploiting a fluid in an expanse of water, which comprises:

- a surface assembly;
- a hybrid tower as defined above, the rigid rising column being fixed on the bottom of the expanse of water, the retaining buoy being connected to an upper end of the rigid rising column by immobilization of the male connecting member in the female connecting member.

BRIEF DESCRIPTION OF THE DRAWINGS

The invention will be better understood upon reading the description which follows, only given as an example, and made with reference to the appended drawings, wherein.

DESCRIPTION OF PREFERRED EMBODIMENTS

Figure 1:
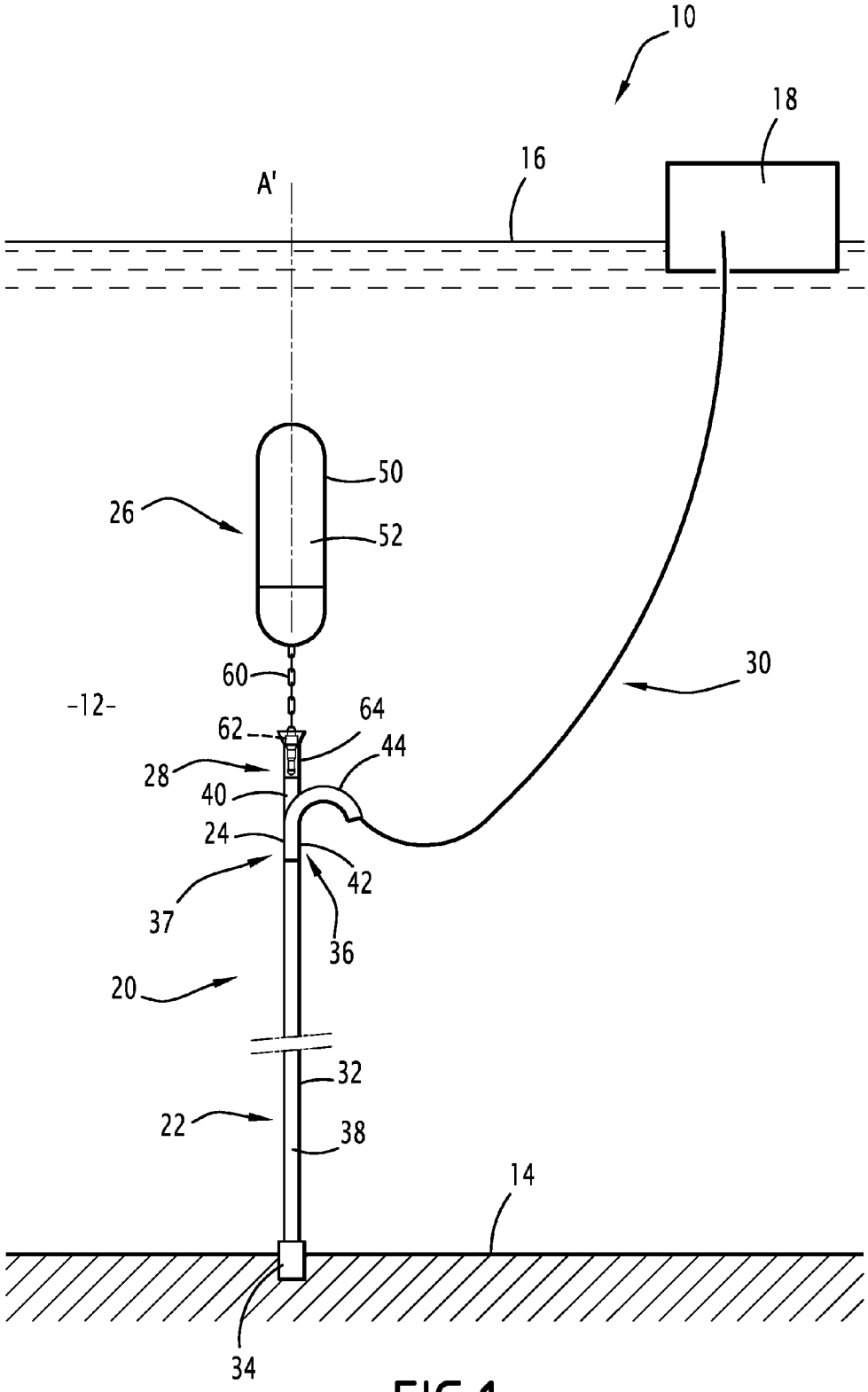
FIG. 1 is a partial side schematic view of a first hybrid tower according to the invention, connected to a surface assembly with view to exploiting a fluid.

A first installation 10 for exploiting a fluid in an expanse of water 12, set up by an installation method according to the invention is schematically illustrated in FIG. 1.

This installation 10 is intended to convey a fluid collected at the bottom 14 of the expanse of water 12 towards the surface 16. The collected fluid is for example a hydrocarbon gas or liquid from a well (not shown) made in the bottom 14 of the expanse of water.

The expanse of water 12 is a lake, a sea or an ocean. The depth of the expanse of water 12, taken between the surface 16 and the bottom 14 is greater than 30 meters and is for example comprised between a 1,000 meters and 3,000 meters.

The installation 10 comprises an assembly 18 for recovering and storing hydrocarbons at the surface and a hybrid tower 20 according to the invention connecting a well head or a production line (not shown) located on the bottom 14 of the expanse of water to the surface assembly 18.

The surface assembly 18 is for example a ship, a barge or a floating platform for recovering, storing or treating hydrocarbons.

According to the invention, the hybrid tower 20 comprises a rigid rising column 22 substantially extending along a vertical axis A-A' between the bottom 14 and an upper end 24 located under the surface 16 of the expanse of water 12.

It also comprises a totally immersed floatability assembly 26 in order to permanently maintain the rigid rising column 22 in its vertical configuration, and means 28 for connecting the floatability assembly 26 on the upper end 24 of the rigid rising column 22.

The hybrid tower 20 further comprises a flexible pipe 30 for connection with the surface assembly 18 connecting the rising column 22, in the vicinity of its upper end 24, to the surface assembly 18. This flexible pipe 30 is for example of the bonded or unbonded type as described in the normative documents published by the American Petroleum Institute (API), API 17J and API 17B.

The rigid rising column 22 comprises a vertical fluid transport pipe 32, means 34 for anchoring the lower end of the pipe 32 in the bottom 14 of the expanse of water 12, and an upper gooseneck connection 36 defining the upper end 24 of the rising column 22. The upper connection 36 is mounted on an arm 37.

The transport pipe 32 is a rigid pipe for example made by assembling metal tubes mounted end to end.

The pipe 32 interiorly defines a vertical passage 38 for transporting hydrocarbons.

The anchoring means 34 for example comprise a foundation, such as a suction pile or a gravity baseplate fixed in the bottom 14 of the expanse of water 12 and a bent connecting joint (not shown) connected to a line for collecting hydrocarbons and/or to a production well.

The upper connecting joint 36 comprises a main section 40 obturating the vertical passage 38 upwards and a mounting bypass 42 of the flexible pipe 30.

The flexible pipe 30 extends as a catenary between the surface installation 18 and the upper connecting joint 36.

The flexible pipe 30 delimits an inner lumen (not shown) for the circulation of hydrocarbons, hydraulically connected to the vertical passage 38 through the upper connecting joint 36.

The floatability assembly 26 comprises a buoy 50 for retaining the pipe 32, totally immersed under the expanse of water 12, the buoy 50 delimiting at least one inner floating compartment 52 at least partly filled with air.

The buoy 50 is for example made on the basis of a hollow metal or plastic box delimiting one or more compartments 52.

The retaining buoy 50 extends vertically along the axis A-A' when it is attached onto the column 22. It is dimensioned in order to exert through its floatability, a tractive force upwards on the rising column 22 opposing the weight of the column 22 in order to maintain it in its vertical configuration along the axis A-A' autonomously, in the absence of other upward traction means.

The height of the buoy 50 taken along the axis A-A', is thus greater than several meters, or even several tens of meters, and its width is greater than one meter.

According to the invention, the connection means 28 comprise a flexible line 60 attached under the retaining buoy 50, a male connecting member 62 attached to the lower free end of the flexible line 60 in order to be borne by the retaining buoy 50, a female connecting member 64, integral with the upper end 24 of the rising column 22, and a clamp 66 for immobilizing the male connecting member 62 in the female connecting member 64.

Figure 2:
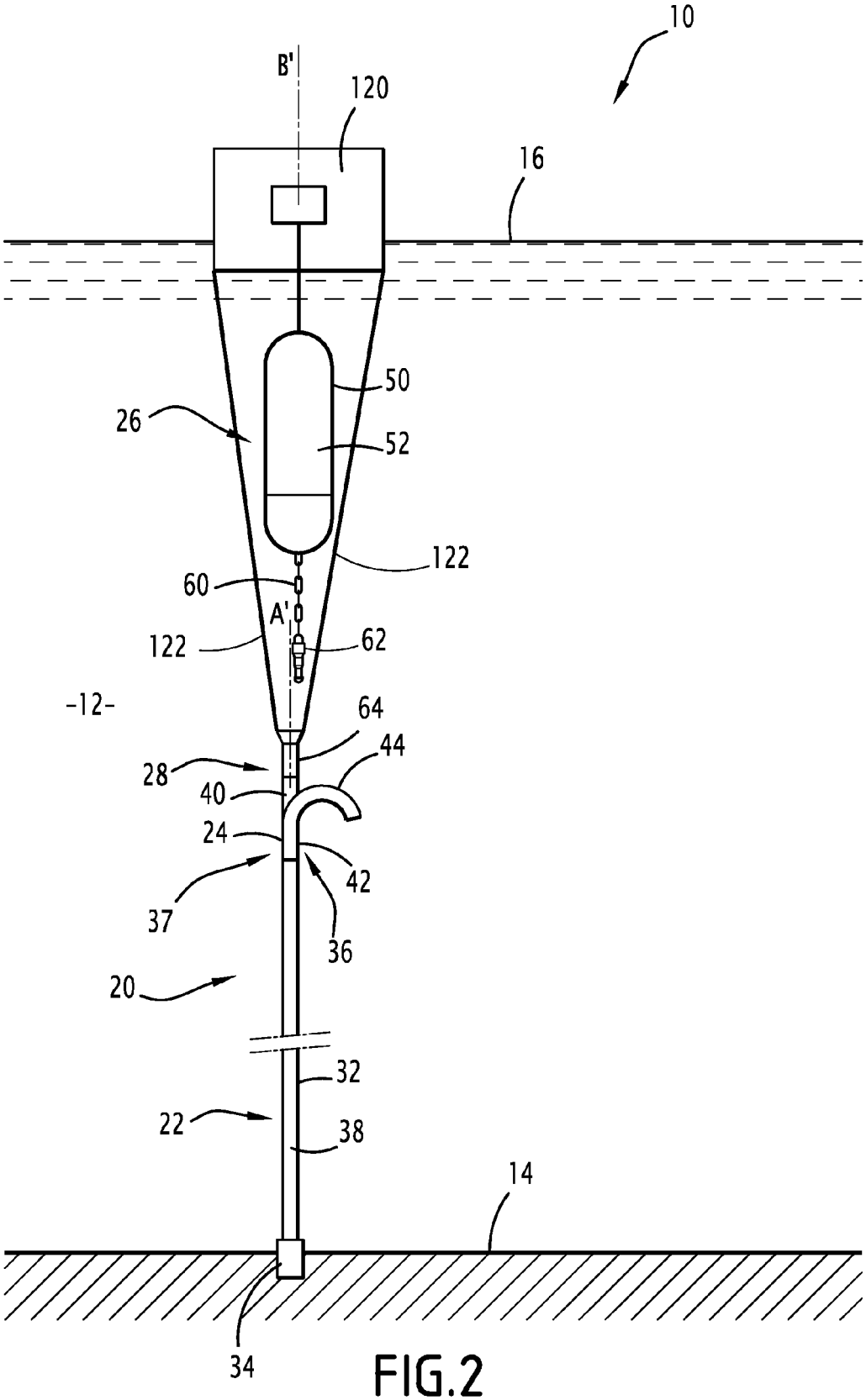
FIG. 2 is a view analogous to FIG. 1, during the connection of the buoy on the rising column of the hybrid tower of FIG. 1.
Figure 3:
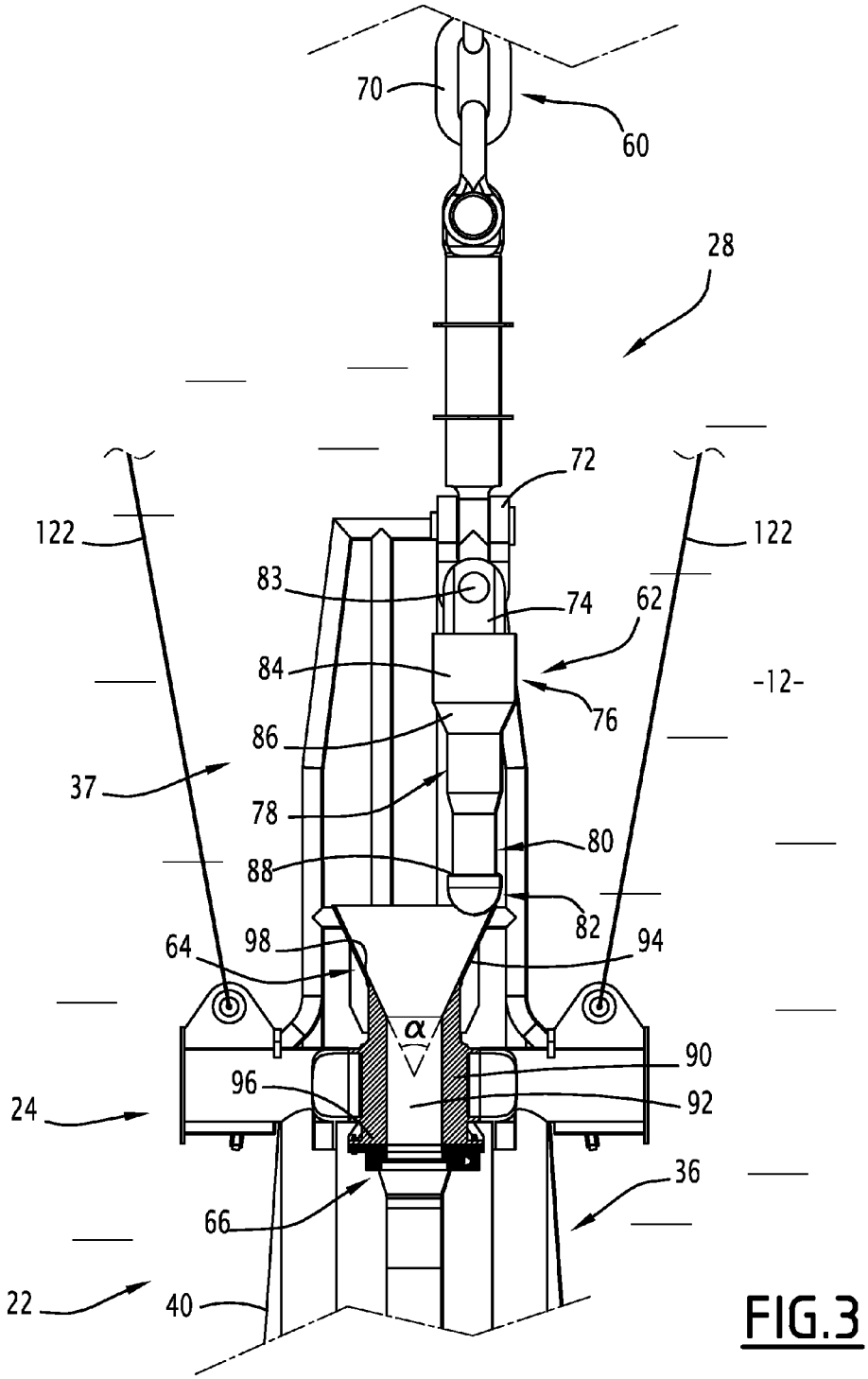
FIG. 3 is an enlarged view, taken as a partial sectional view along a median vertical plane, of connection means between the buoy and the rising column during a first connection step.

As illustrated by FIGS. 1 and 2, the flexible line 60 comprises a chain 70 which has at its lower end a Cardan joint 72, on which the male connecting member 62 is jointed.

When the male member 62 is immobilized in the female member 64 and when the buoy 50 exerts a tractive force upwards, the flexible line 60 is tensioned between its ends so as to extend coaxially with the rising column 22 along the axis A-A'.

As illustrated by FIGS. 3 to 6, the male connecting member 62 is formed by a torpedo which comprises, from top to bottom in the figures, a fork joint 74 on the Cardan joint 72, an upper guiding portion 76, an intermediate portion 78 for insertion into the female member 64, a thinned lower portion 80 and a retaining endpiece 82.

The fork 74 is pivotally mounted around a transverse axis in the Cardan joint 72 via a pivot 83.

The upper portion 76 has a cylindrical upper region 84 and a chamfered lower region 86 intended to bear against the female member 64.

The diameter of the upper portion 76 in the upper region 84 is greater than the average diameter of the intermediate portion 78, which is greater than the average diameter of the thinned lower portion 80.

The intermediate portion 78 is also of a generally cylindrical shape extended downwards by a chamfer which converges around the thinned portion 80.

The endpiece 82 has the general shape of a half sphere, with convexity directed downwards. It delimits an upper surface 88 converging upwards around the thinned portion. The upper surface 88 protrudes radially with respect to the thinned portion 80 and forms a retaining abutment intended to co-operate with the immobilization clamp 66, as this will be seen below.

The male connecting member 62 is transversally mobile with respect to the axis A-A' of the line 60 and of the buoy 50, by free rotation around the pivot 83, between an axial rest configuration substantially coaxial with the axis A-A' and a configuration tilted by a non-zero angle relatively to the A-A' axis for introducing a male member 62 into the female member 64, as this will be seen below.

The female member 64 comprises, from bottom to top in FIGS. 2 to 6, a lower sleeve 90 delimiting a receiving passage 92 for immobilizing the male member 62, and a funnel 94 for guiding the male member 62 towards the receiving passage 92.

The sleeve 90 is of a generally cylindrical tubular shape. It is attached at its periphery onto the arm. It delimits a lower flange 96 for attaching the immobilization clamp 66.

The passage 92 extends along the axis A-A' of the rising column 22. It opens out downwards into the arm 37 and upwards into the funnel 94.

The length of the passage 92 is smaller than the length of the male member 62 so that when the male member 62 is inserted into the passage 92, upon abutment against the funnel 94, the retaining endpiece 82 protrudes out of the passage 92.

The passage 92 has a constant cross section over its length, combined with the section of the intermediate portion 78 of the male member 62.

The funnel 94 extends in the axial extension of the sleeve 90, above the latter. In the example illustrated in the figures, it is made with the sleeve 90 out of the same material.

The funnel 94 interiorly defines around the axis A-A', a surface 98 for guiding the male member 62.

The guiding surface 98 is a solid surface which has a section, taken in a vertical axial plane, which diverges from and away from the passage 92 upwards and towards the male member 62 upon introducing the male member into the female member 64. Alternatively, the surface 98 is open-worked.

The guiding surface 98 is thus frusto-conical with an aperture angle $\alpha$, taken in at least one vertical axial plane, greater than 20° and advantageously substantially equal to 25°.

The minimum transverse extent of the guiding surface 98, taken along its free edge located away from the sleeve 90, is greater than about 1 meter.

As this will be seen in detail below, the male member 62 is axially mobile relatively to the female member 64, between an upper disconnected position illustrated in FIG. 2, in which the male member 62 is located above and axially away from the female member 64, an intermediate guiding position, illustrated in FIG. 4, in which the male member 62 is partly introduced into the funnel 94 and a lower connected position, illustrated in FIG. 6, in which the male member 62 is inserted into the passage 92.

Figure 7:
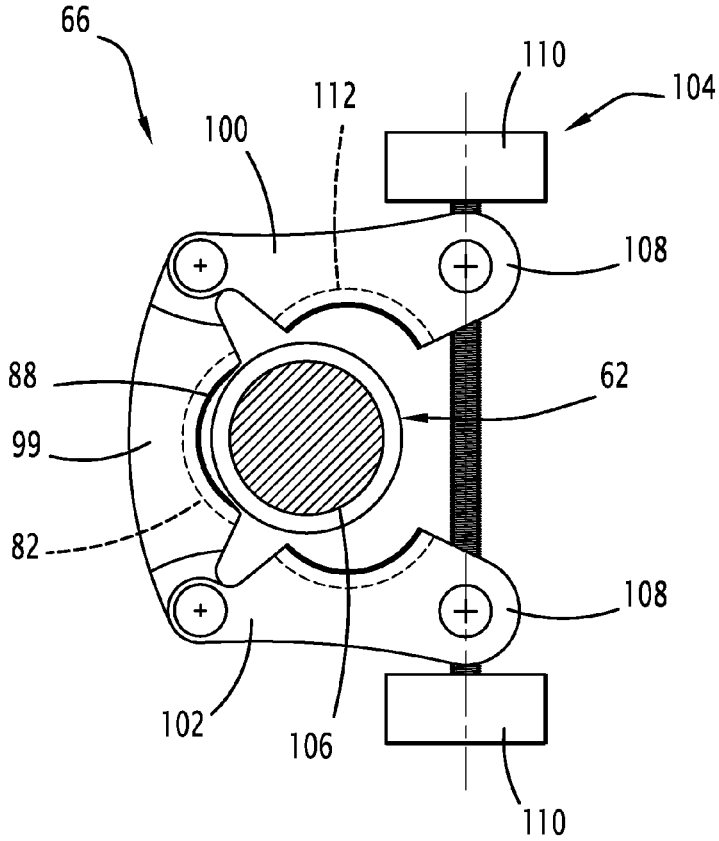
FIG. 7 is a sectional view along the horizontal plane VII of FIG. 6, before immobilization of the male connecting member in the female connecting member.
Figure 8:
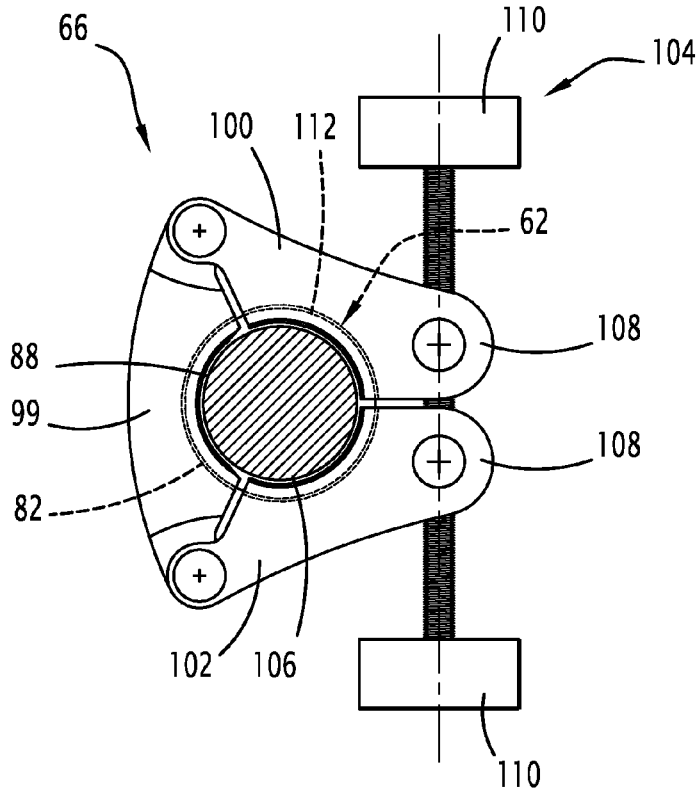
FIG. 8 is a view analogous to FIG. 7 after immobilization of the male connecting member in the female connecting member.

As illustrated by FIGS. 7 and 8, the immobilization clamp 66 comprises a base 99 attached under the female member 64, two mobile jaws 100, 102 facing each other in order to clasp the retaining endpiece 82 and a controllable screw 104 for tightening the jaws 100.

The jaws 100, 102 are jointed on the base 99 around an axis parallel to the vertical axis A-A' so as to be moved in a substantially horizontal plane.

The base 99 and the jaws 100, 102 define between them an opening 106 for inserting the endpiece 82, with variable section and controlled by the displacement of the screw 104.

The screw 104 is transversally mounted between the free ends 108 of the jaws 100, 102. They comprise control thumb-wheels 110.

The thumb-wheels 110 are actuatable, for example by a diver or by a remote-controlled vehicle (designated as "Remote Operated Vehicle" or "ROV") between an open configuration of the clamp 66, as illustrated in FIG. 7 and a closed configuration of the clamp 66, as illustrated in FIG. 8.

In the open configuration, the jaws 100, 102 and their free ends 108 are far away from each other. The central opening 106 then has maximum section, greater than the maximum cross-section of the endpiece 82.

In the closed configuration, the jaws 100, 102 and their free ends 108 are brought closer to each other by pivoting with respect to the base 99 around a vertical axis. The free ends 108 are then substantially in contact.

Figure 6:
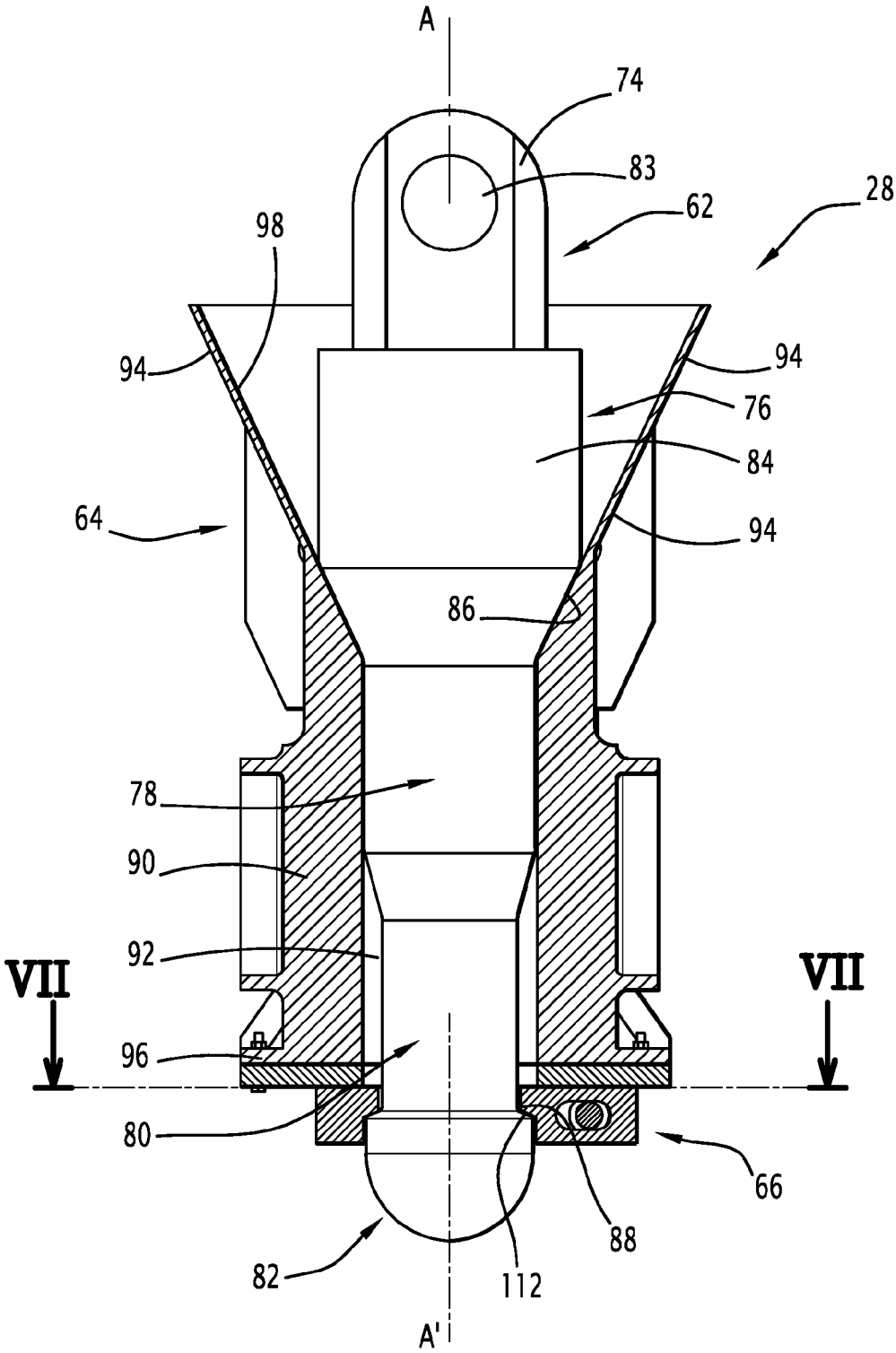
FIG. 6 is a view analogous to FIG. 3 at a larger scale during a fourth connection step.

The opening 106 then has a minimum closed cross-section smaller than the maximum cross section of the endpiece 82, As illustrated by FIG. 6, the jaws 101, 102 and the base 99 then delimit around the opening 106, a ring-shaped shoulder 112 for retaining the endpiece 82.

The upper surface 88 of the retaining endpiece 82 is complementarily supported under the shoulder 112.

A first method for setting up the hybrid tower 20 according to the invention will now be described with reference to FIGS. 2-8.

Initially, the rising column 22 is assembled and is lowered into the expanse of water 12 by means of a laying ship 120, as illustrated in FIG. 2.

In order to carry out this assembling and this lowering, a "J-Lay" or alternatively an "S-Lay" method, well known to one skilled in the art, are used for example.

The anchoring and connecting means 34 are then fixed on the bottom 14 of the expanse of water 12. The rigid rising column 22, provided with its upper connection 36 is releasably moored to the laying ship 120 through mooring lines 122 for maintaining it in a substantially vertical configuration along the axis A-A', as illustrated by FIG. 2.

Next, the buoy 50 is immersed into the expanse of water 12 and is brought facing the rising column 22. To do this, a first technique (not shown) consists of towing the buoy 50 by having it float horizontally on the expanse of water 12. Next, the buoy 50 is pivoted in order to place it along a vertical axis, by gradually introducing water into the inner space 52.

The buoy 50 is then positioned under the laying ship 120 by a so-called pendular technique up to the vertical configuration illustrated in FIG. 2.

In an alternative, the buoy 50 is stored on the laying ship 120 and is lowered into the sea vertically via a crane.

The buoy 50 is then lowered downwards to the bottom 14 of the expanse of water 12 by gradually bringing the male connecting member 62 in its disconnected position closer to the female connecting member 64.

Taking into account the presence of the guiding funnel 94 delimiting a guiding surface 98 diverging upwards, and taking into account the joint of the male member 62 around the fork 70, the local vertical axis B-B' of the buoy 50, of the line 60 and of the male member 62 does not necessarily coincide with the axis A-A' of the rising column 22 in the vicinity of the female connecting member 64, when the male member 62 moves closer to the female member 64 and during the initial contact between these members 62, 64.

Thus, a lateral shift by more or less 50 centimeters may be tolerated at the moment of the contact. The connection of the male member 62 and of the female member 64 is thereby considerably facilitated.

When the male member 62 comes into contact through its endpiece 82 with the upper edge of the funnel 94, it pivots from its axial configuration towards its tilted configuration by sliding against the guiding surface 98 in order to occupy its intermediate guiding position in which the upper region 84 of the guiding portion 76 bears against the surface 98.

Figure 4:
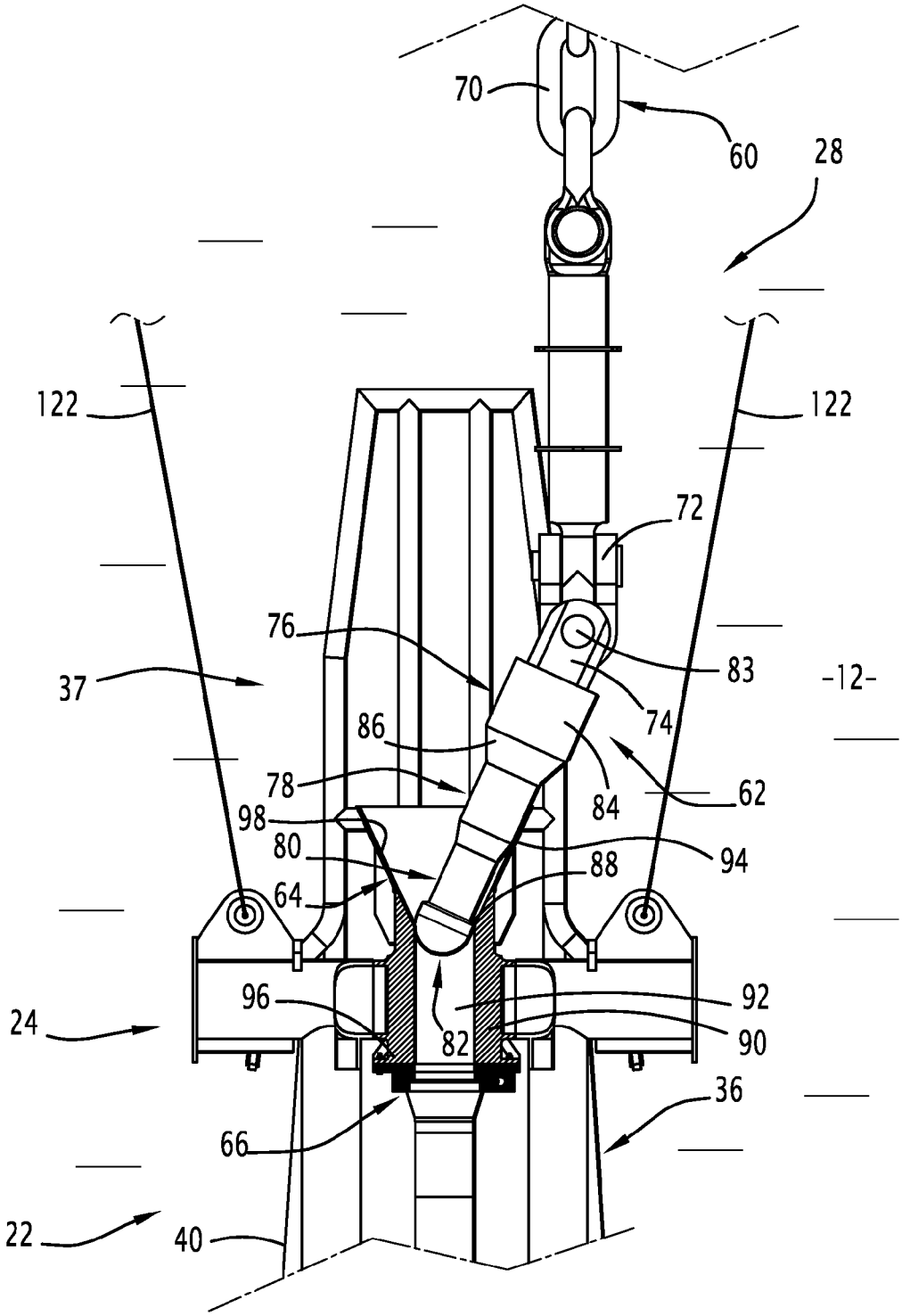
FIG. 4 is a view analogous to FIG. 3, during a second connection step.
Figure 5:
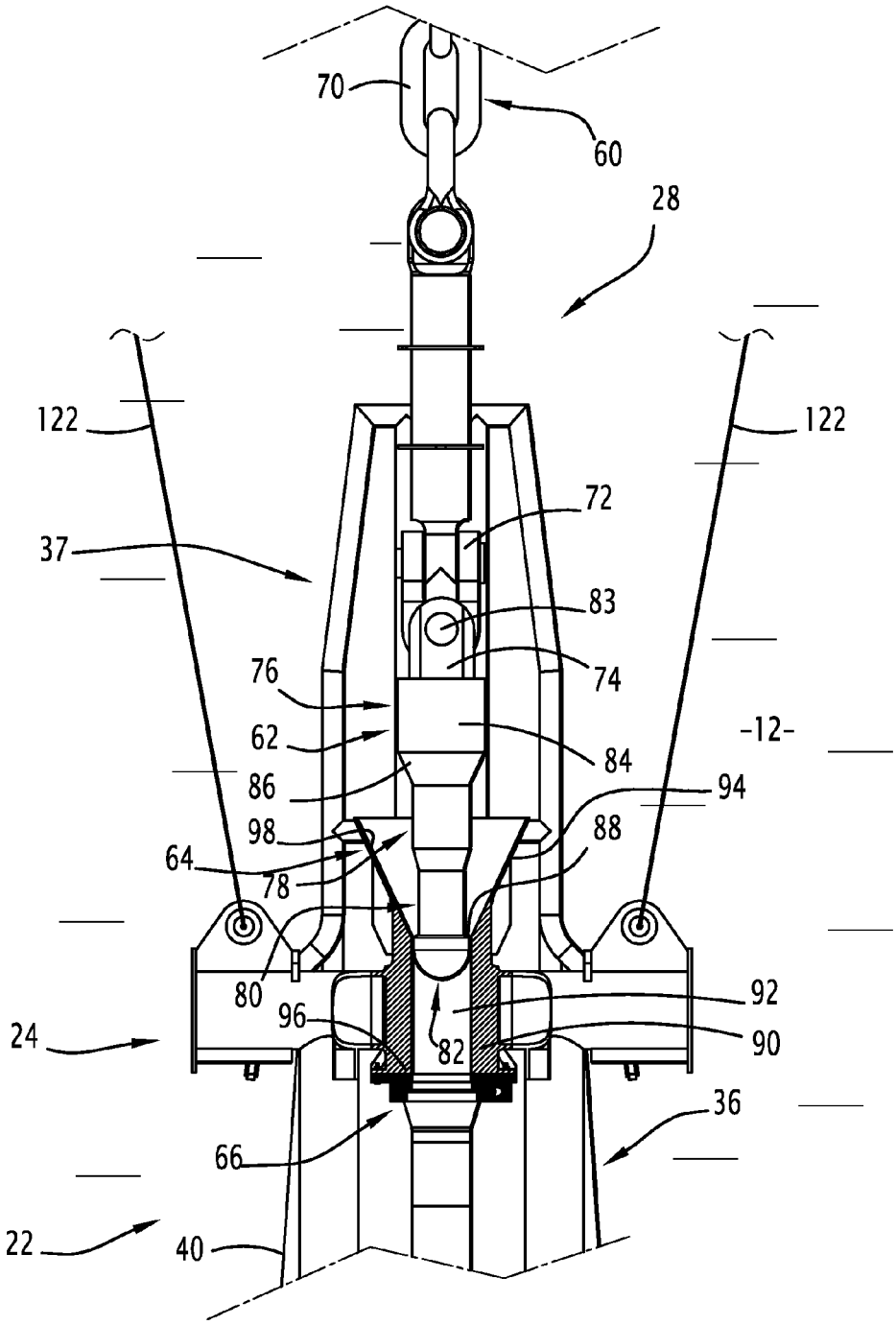
FIG. 5 is a view analogous to FIG. 3 during a third connection step.

The male member 62 and its endpiece 82 are then naturally guided towards the passage 92 through contact between the male member 62 and the guiding surface 98, as illustrated by FIG. 4.

Next, when the endpiece 82 penetrates into the passage 92, the buoy 50 is re-aligned with respect to the rising column 22 so that the male connecting member 62 again occupies its axial configuration with an axis coinciding with the axis A-A' of the column 22.

The downward movement of the male member 62 into the receiving passage 92 delimited by the female member 64 then continues until the lower bevelled region 86 of the upper guiding portion 76 comes into contact with the bottom of the guiding surface 98 around the entrance of the receiving passage 92.

In this inserted lower position, the intermediate portion 78 and the lower portion 80 are positioned in the receiving passage 92 and are blocked in this passage 92 by shapes mating those of the intermediate portion 78 and the sleeve 90.

Further, the endpiece 82 protrudes downwards outside the passage 92 facing the jaws 100, 102 into the opening 106.

A diver or a remote-controlled vehicle is then activated for controlling the screw 104 and moving the clamp 66 from its open configuration to its closed configuration.

During this passage, the jaws 100,102 move closer to the endpiece 82 so as to come into contact with the latter. The upper abutment surface 88 is then received complementarily into the ring-shaped retaining shoulder 112.

Next, the mooring lines 122 connecting the laying ship 120 to the rising column 22 are disconnected from the rising column 22. Because of its floatability, the buoy 50 tends to move upwards and generate a tractive force directed upwards which is transmitted to the male connecting member 62 through the flexible line 60.

This force is then transmitted to the female member 64 integral with the rising column 22, by the upper surface 88 bearing upwards against the shoulder 112 in the clamp 66.

As the rising column 22 is retained at its lower end by the anchoring means 34, the buoy 50 then maintains autonomously the rising column 22 in a substantially vertical configuration, against the weight of the column 22.

Next, the flexible pipe 30 is deployed in the expanse of water 12 and is connected through its lower end 44 to the bypass 42 of the upper connection 36.

Fluid collected in the bottom 14 of the expanse of water is then brought upwards to the surface assembly 18 through the transport passage 38 of the pipe 32 and through the inner lumen of the flexible pipe 30.

In an alternative, the male member 62 is mounted so as to be integral with the upper end 24 of the rising column 22, while protruding upwards. The female member 64 is jointed on the line 60 with its guiding surface 98 diverging downwards, towards the male member 62 upon introducing the male member 62 into the receiving passage 92.

What is claimed is:

1. A method for setting up a hybrid tower in an expanse of water of the type comprising the following steps:

positioning and temporarily retaining a rigid rising column in a substantially vertical configuration in the expanse of water;

totally immersing a buoy for retaining the rising column and moving the retaining buoy facing the rising column;

inserting a male connecting member borne by a first of the rising column and of the retaining buoy into a female connecting member borne by a second of the rising column and of the retaining buoy;

immobilizing the male connecting member in a receiving passage defined by the female connecting member;

wherein the female connecting member comprises at least one surface for guiding the male connecting member towards the receiving passage, the guiding surface opening out around the receiving passage and having a vertical section diverging away from the receiving passage towards the male connecting member upon introducing the male connecting member into the female connecting member, the insertion step comprising the guiding of the male connecting member towards the receiving passage by contact with the guiding surface;

wherein one of the male connecting member and of the female connecting member borne by the retaining buoy is mounted so as to be transversally mobile relatively to the retaining buoy between an axial rest configuration substantially parallel to a vertical axis and a guiding configuration tilted by a non-zero angle with respect to the vertical axis; and the insertion step comprising the displacement of the one of the male connecting member and of the female connecting member borne by the retaining buoy between its axial configuration and its tilted configuration upon contact of the male connecting member with the guiding surface.

2. The method according to claim 1, wherein the retaining buoy is connected to the one of the male connecting member and of the female connecting member borne by the retaining buoy by a substantially vertically line, the one of the male connecting member and of the female connecting member borne by the retaining buoy being pivotally mounted around a transverse axis on the line.

3. The method according to claim 1, wherein the immobilization step comprises the clamping of the male connecting member by an immobilization clamp mounted on the female connecting member.

4. The method according to claim 1, wherein it comprises after the immobilization step, a step for connection to the rigid rising column of a flexible pipe for connecting a surface assembly, the flexible connection pipe being connected in the vicinity of the male connecting member and of the female connecting member.

5. A hybrid tower, intended to be positioned in an expanse of water of the type comprising:

a rigid rising column intended to be positioned according to a vertical configuration in the expanse of water;

a buoy for retaining the rising column, the retaining buoy being intended to be totally immersed in the expanse of water;

a connector connecting the retaining buoy to an upper end of the rising column, the connector comprising a male connecting member borne by a first of the retaining buoy and of the rising column, and a female connecting member borne by a second of the retaining buoy and of the rising column;

the male connecting member and the female connecting member being mobile relatively to each other between a disconnected position and a connected position in which the male connecting member is received in a receiving passage defined by the female connecting member;

wherein the female connecting member delimits a surface for guiding the male connecting member opening out into the receiving passage, the guiding surface being of a substantially frusto-conical shape and diverging away from the receiving passage towards the male connecting member upon introducing the male connecting member into the female connecting member; and wherein one of the male connecting member and of the female connecting member borne by the retaining buoy is mounted so as to be transversally mobile relative to the retaining buoy between an axial rest configuration substantially parallel to a vertical axis and a guiding configuration tilted by a non-zero angle with respect to the vertical axis.

6. The hybrid tower according to claim 5, wherein the guiding surface is a solid surface.

7. The hybrid tower according to claim 5, wherein the retaining buoy is connected to the one of the male connecting member and of the female connecting member borne by the retaining buoy by a substantially vertical line, the one of the male connecting member and of the female connecting member borne by the retaining buoy being pivotally mounted around a transverse axis on the line.

8. The hybrid tower according to claim 5, wherein the connector comprises a clamp for immobilizing the male connecting member in the receiving passage the immobilization clamp being mounted on the female connecting member.

9. The hybrid tower according to claim 5, wherein it comprises a flexible pipe for connecting with a surface assembly, the flexible connecting pipe being connected to the rigid rising column in the vicinity of the connecting means.

* * * * *

UNITED STATES PATENT AND TRADEMARK OFFICE

CERTIFICATE OF CORRECTION

PATENT NO. : 8,555,982 B2
APPLICATION NO. : 13/000675
DATED : October 15, 2013
INVENTOR(S) : Ange Luppi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 351 days.

Signed and Sealed this
Fifteenth Day of September, 2015

Michelle K. Lee

Michelle K. Lee
*Director of the United States Patent and Trademark Office*